United States Patent [19]

Shoemaker

[11] Patent Number: 4,634,195

[45] Date of Patent: Jan. 6, 1987

[54] ELECTRICAL INTERCONNECTION DEVICE

[75] Inventor: John R. Shoemaker, Reidsville, N.C.

[73] Assignee: AMP Incorporated, Harrisburg, Pa.

[21] Appl. No.: 747,092

[22] Filed: Jun. 20, 1985

[51] Int. Cl.[4] ..... H01R 9/09

[52] U.S. Cl. ..... 339/17 F

[58] Field of Search ..... 339/17 F, 75 MP, 75 M, 339/176 MF, 176 MP

[56] References Cited

U.S. PATENT DOCUMENTS

| | | | |
|---|---|---|---|
| 4,169,641 | 10/1979 | Olsson | 339/17 F |
| 4,172,626 | 10/1979 | Olsson | 339/17 F |
| 4,181,386 | 1/1980 | Olsson | 359/17 F |
| 4,252,389 | 2/1981 | Olsson | 339/17 F |
| 4,379,608 | 4/1983 | Olsson et al. | 339/75 MP |

FOREIGN PATENT DOCUMENTS

| | | | |
|---|---|---|---|
| 1039037 | 8/1983 | U.S.S.R. | 339/176 MF |

*Primary Examiner*—Neil Abrams

*Attorney, Agent, or Firm*—Katherine A. Nelson

[57] ABSTRACT

An electrical interconnection device intended for interconnecting an array of conductors in a cable to conductors on a substrate is disclosed. The device is comprised of a spring metal member having means securing said device to a substrate, a stamped and formed body with a first and second section joined by an intermediate bight. The first and second sections are mutually relatively deflectable about the bight to a second position and a locking means to retain said device in its second position. Energy is stored in the body in its second position whereby upon positioning the cable conductors between the second body section and the circuitry and deflecting the first section to the second position and engaging said lock, the stored energy is transmitted through the second section to the conductor array to maintain a normal force on the substrate.

16 Claims, 9 Drawing Figures

ELECTRICAL INTERCONNECTION DEVICE

FIELD OF THE INVENTION

This invention relates to electrical interconnection devices of the type intended for connecting cable conductors to conductors on a circuit board and in particular to those devices requiring zero insertion force.

BACKGROUND OF THE INVENTION

When the conductors in a flat conductor cable must be disengageably connected to conductors on a circuit board, it is common practice to use electrical connectors of a type comprising an insulating housing having contact terminals therein which are soldered to the conductors on the circuit board. The housing and the contact terminals are arranged such that the end of the flat conductor cable can be inserted into the housing and upon insertion, the conductors of the cable will be electrically contacted by the contact terminals. Other types of connectors for connecting flat conductor cable conductors to conductors on a circuit board are also known and most of them consist of an insulating housing containing contact terminals which conduct current from the cable conductors to the circuit board conductors.

It is also known to use devices such as connector clip to connect conductors of a flat conductor cable to conductors on a circuit board. Devices of this type are disclosed in U.S. Pat. Nos. 4,169,641; 4,172,626; 4,181,386; and 4,252,389.

U.S. Pat No. 4,169,641 discloses a connector clip device for connecting the conductors of a flat conductor cable to conductors on a circuit board comprised of a single one-piece stamped and formed device which holds the cable conductors directly against the circuit board conductors. The connector is a flat clip member having parallel spaced-apart coplanar support strips and a clip bar which extends between the support strips in a plane which is offset from the plane of the support strips. A plurality of cantilever springs extend from the clip bar obliquely towards and past the plane of the support strips. The connector clip is mounted on the circuit board in straddling relationship to the circuit board conductors with the cantilever springs in alignment with the circuit board conductors. The end of the flat conductor cable is inserted beneath the clip bar and pushed parallel to the springs and the support strips until the cable is beneath the free ends of the springs and the cable conductors are against the circuit board conductors. The springs bear against the insulated top surface of the cable so that the circuit board conductors and the cable conductors are pressed against each other to establish electrical contact. The clip does not carry an electrical current but merely clamps the conductors together.

U.S. Pat. No. 4,172,626 discloses and claims a one-piece stamped and formed connector clip which is adapted to be mounted on a circuit board in straddling relationship to a plurality of parallel side-by-side conductors on the circuit board. The clip serves to connect conductors on a thin film to the circuit board. The clip has a plurality of cantilever springs extending from one of its edges which bear resiliently against the circuit board conductors when the clip is mounted on the circuit board. The clip does not carry an electrical current but merely clamps the film conductors against the circuit board conductors. The conductors on the film are disengageably connected to the circuit board conductors by simply inserting a portion of the film between the spring members of the clip and the surface of the board so that the springs serve to clamp the film conductors against the circuit board conductors. Connector clips also can be used to connect cable conductors to terminal posts extending from a board or to flat conductors on the surface of the circuit board.

Connector clips of the types disclosed in the two patents discussed above can be used successfully and to advantage when the film is comparatively strong and firm and the conductors are durable and resistant to damage from abrasion. Thus, clips as described in the above patents can be used for example where the film is relatively heavy such as a polyester film and the conductors are of wrought copper conductors bonded to the film.

Difficulties are encountered when it is attempted to use such a connector clip with extremely thin films having fragile conductors on their surface. The thin films tend to buckle when an attempt is made to insert them between the springs of the connector slip and the surface of the circuit board against which the springs are biased. The fragile conductors such as printed conductors and screened conductors, which are widely used on extremely thin films are, furthermore, damaged during insertion of the film for the reason that they cannot withstand the abrasive effects of the springs as they are inserted between the connector clip and the surface of the circuit board.

U.S. Pat. Nos. 4,181,386 and 4,252,389 disclose connector clips having zero insertion force characteristics, that is an arrangement whereby the film can be inserted when the contact springs are spaced from the conductors on the surface of the circuit board so that no compressive forces are imposed on the film or on the conductors during insertion.

The connector clip disclosed and claimed in U.S. Pat. No. 4,181,386 is comprised of a rectangular clip bar having spaced-apart cantilever springs extending from one of its side edges. These springs are reversely bent adjacent to the one side edge and extend from the bent portion diagonally towards the conductors on the surface of the circuit board. Each spring is resiliently biased against a conductor when the clip is mounted on the circuit board so that a cable or film can be inserted between the springs and the surface of the circuit board and the springs will press the film conductors against the circuit board conductors. The zero insertion force feature is achieved by providing the free ends of the spring members with tool-engageable portions and constructing the clip for cooperation with a tool which is uniquely suited to engage the free ends of the springs and raise them from the surface of the circuit board during insertion of the film.

The device disclosed and claimed in U.S. Pat. No. 4,252,389 is of the general class described in U.S. Pat. No. 4,181,386. The zero insertion force feature is achieved, however, by providing an integral unloading means for the springs that does not require the use of a specialized tool. The clip is comprised of a one-piece stamped and formed member having a clip bar and having cantilever springs extending from one side edge of the clip bar. The springs are reversely bent and have spring arm portions which extend towards, and are resiliently biased against, the circuit board conductors when the clip is mounted on the circuit board, the contact areas being beneath the clip bar. Each spring has an end portion which extends from the contact area diagonally away from the surface of the circuit board and beyond the other side edge of the clip bar. A lifting bar is provided at the ends of the springs so that the springs can be raised from the surface of the circuit board by merely moving the lifting bar away from the surface of the circuit board.

SUMMARY OF THE INVENTION

The present invention is directed to a zero insertion interconnection device for connecting cable conductors to conductors on a circuit board and in particular to a device for interconnecting conductors in cables that approach the board in a direction essentially horizontal to the board. An assembly for interconnecting conductors in cables that approach the board in a direction essentially vertical to the board is disclosed in U.S. Pat. application Ser. No. 747,088 entitled Electrical Interconnection Assembly and filed concurrently herewith.

The electrical interconnection device disclosed herein is comprised of a unitary spring metal member. The spring metal member has a first means for securing the said member to the substrate; a formed metal body having a first section and a second section joined by an intermediate bight and a locking means for retaining said first and second sections in locking engagement. The first and second body sections are relatively inclined about an acute included angle in a first position, the first and second sections being mutually relatively deflectable about the bight to a second position in which the relative inclination therebetween is less than in the first position. The lock depends from the first section and is used for retaining the first and second sections in the second position. Energy is stored in the body in the second position, whereby upon positioning the array of conductors between the second body section and the circuitry on the substrate and deflecting the first section to the section position to engage the lock, the stored energy is transmitted through the second section to the conductor array to maintain a normal force electrical connection between the conductors in the array and the circuitry on the substrate.

BRIEF DESCRIPTION OF THE DRAWINGS

FIG. 3 is a view similar to FIG. 2 showing device in its second or closed position.

DESCRIPTION OF THE PREFERRED EMBODIMENT

Figure 1:
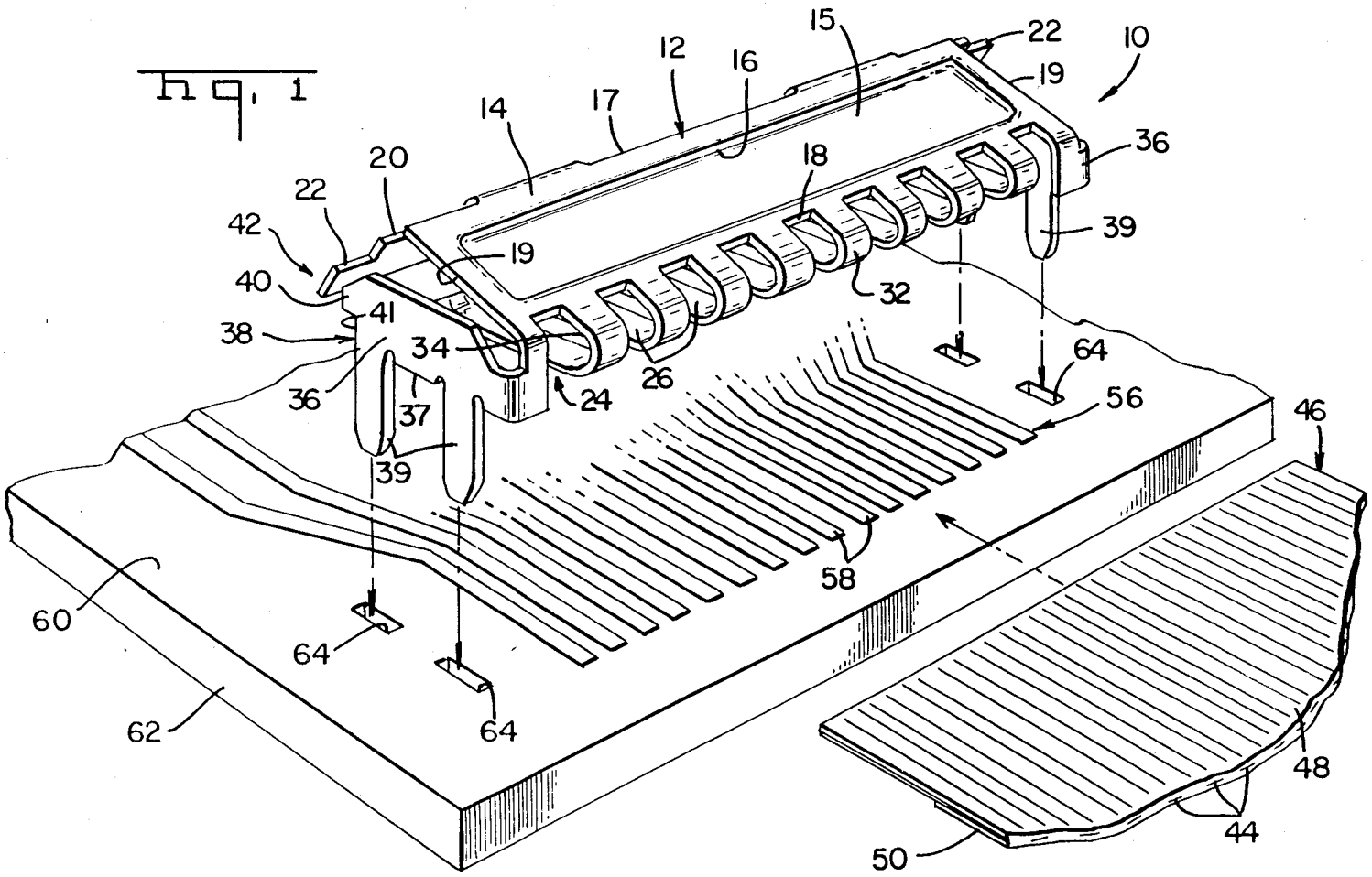
FIG. 1 is a perspective view of the electrical interconnection device showing the device and a cable for use with the device, exploded from the substrate.
Figures 2, 8, 9:
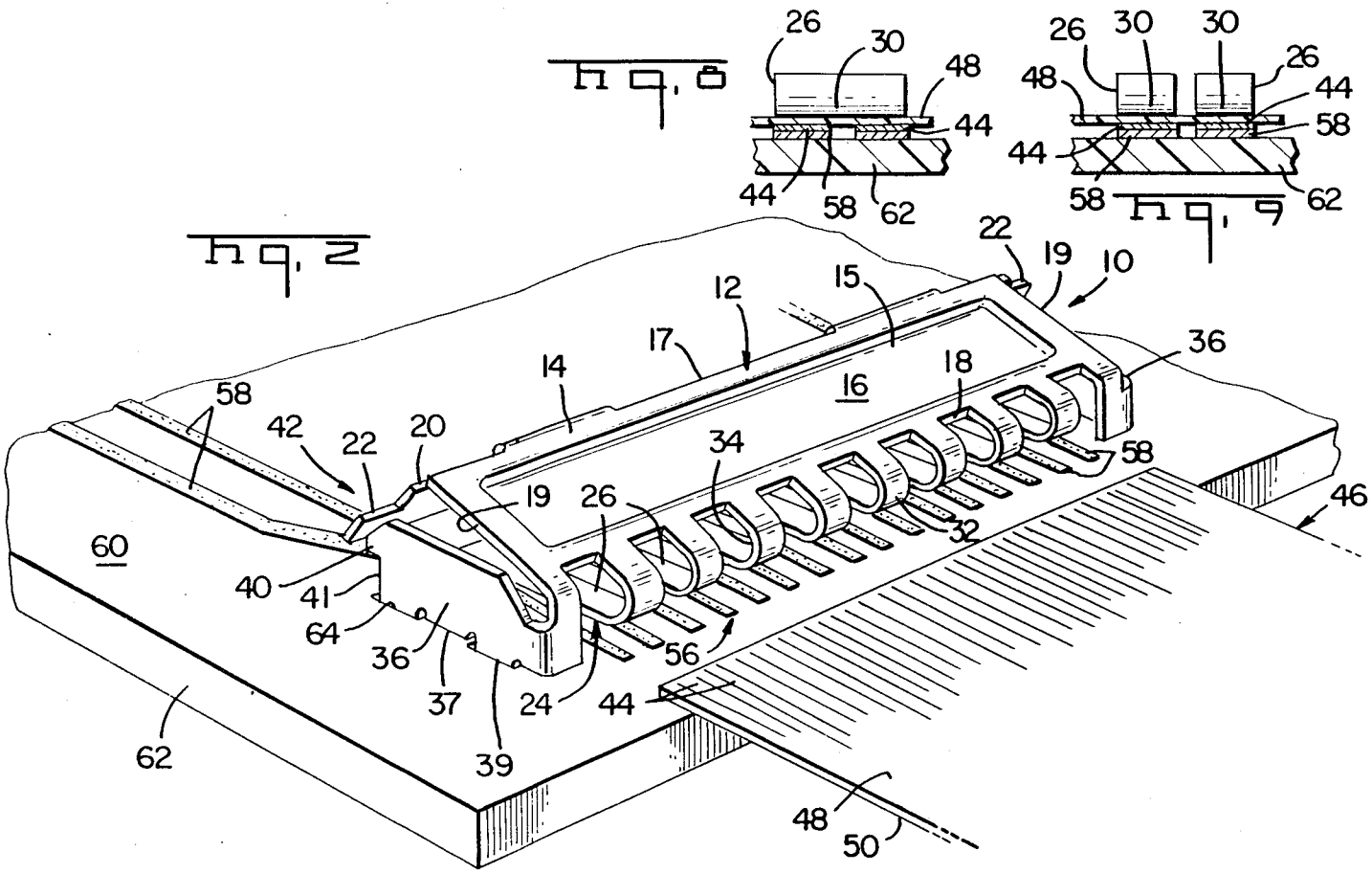
FIG. 2 is a view similar to FIG. 1 showing the device in its open or first position mounted to the substrate and a cable inserted between the device and substrate.
FIG. 8 is an enlarged view of the end of the spring arm exerting force on two conductors.
FIG. 9 is similar to view 8, illustrating the end of a spring arm exerting force on one conductor interconnection.

Referring first to FIGS. 1 to 3, an electrical interconnecting device 10 in accordance with the invention serves to connect an array of conductors 44 in a cable 46 to corresponding circuitry 56 on a surface 60 of a substrate 62.

The interconnecting device 10 is a unitary spring metal member having a body 12 comprised of a first or upper section 14, a second or lower section 24 and an intermediate bight section 32 which connects said first and second sections 14, 24.

The first section 14 is comprised of a rectangular plate member 15 having first and second essentially parallel side edges 17, 18 and end edge 19. The plate member 15 may be embossed as shown at 16 to improve its stiffness along its entire length between the end edges. The first side edge 17 has a downwardly directed flange 20 extending therefrom. The flange 20 has locking extensions 22 which extend beyond the end edges 19 of the bar member 15.

The second body section 24 is comprised of at least one and preferably a plurality of cantilever spring arms 26, said spring arms 26 being reversely bent through the bight section 32 and joined to the second edge 18 of the plate member 15.

Figure 4:
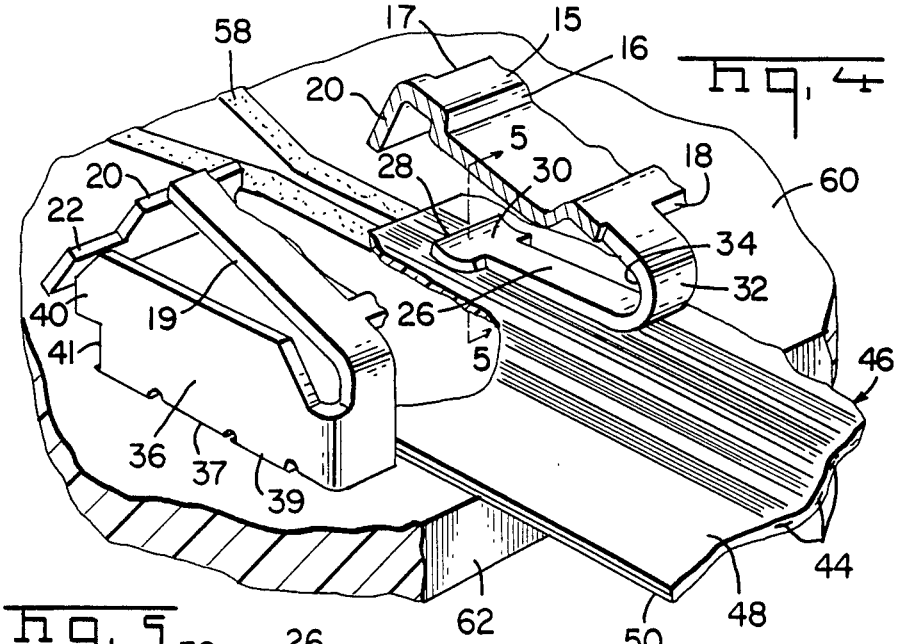
FIG. 4 is a fragmentary cross-sectional view of one spring arm member and the locking means of the disclosed invention, said device being in its open position.
Figure 5:
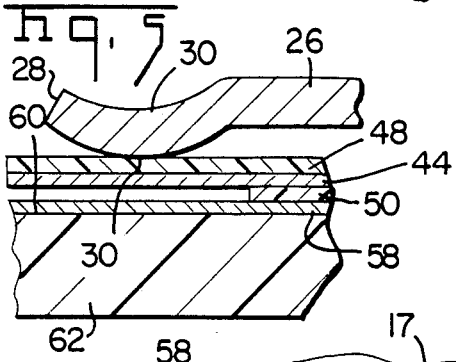
FIG. 5 is a cross sectional view taken along line 5—5 of FIG. 4 showing the end of spring arm.
Figure 7:
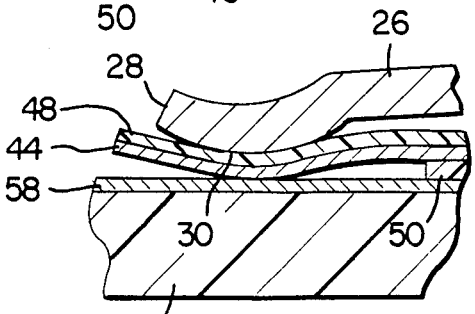
Figure 6:
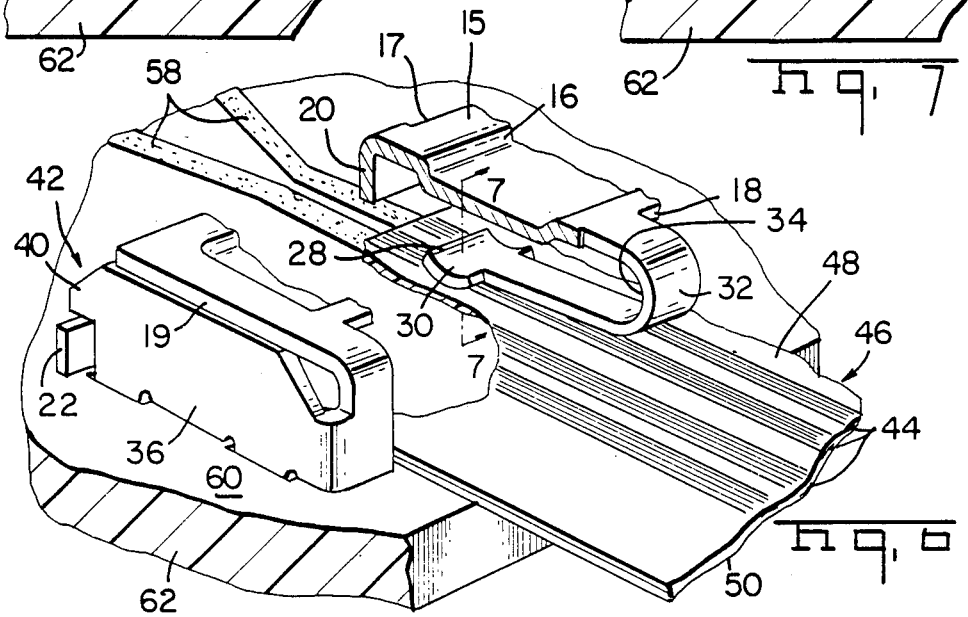
FIG. 6 is a view similar to FIG. 4 but having the device in its closed or second position.

The spring arms 26 are reversely formed at their free ends 28 as shown in FIGS. 4 through 7 to define a pressure applying arcuate portion 30 on each spring arm 26. As is best seen in FIGS. 4 and 6, the reverse bend in the bight section 32 is such that the cantilevered spring arms 26 lie under the plate member 15.

The first and second body sections 14 and 24 are relatively inclined about an acute included angle 34 in the intermediate bight section 32 and are mutually relatively deflectable about the bight section 32. The relative size of the angle 34 changes as device 10 is moved from its open to its closed position as is seen in FIGS. 1–3.

The bight section further has at least one end section 36 extending from the second edge 18 of the bar member, said end section 36 providing mounting means 38 and part of the locking means 42 for the device 10. End section 36 is bent downwardly and forwardly from the bar member 15 so that the end section 36 is oriented in a plane mutually perpendicular to the first and second sections 14, 24 in both the first or open position and the second or closed position. In the embodiment shown in FIGS. 1–3, the mounting means are leg members 39 which extend downwardly from the lower edge 37 of said end section 36 and are used to secure device 10 to substrate 62. The mounting means 38 secures the device 10 to the substrate 62 independently of the spring arms 26 and support the device 10 so that the spring arms 26 are spaced from the substrate 62 when the device 10 is in its open position. It is to be understood that other mounting means may also be used. The ends 36 further have integral locking ears 40 which extend forwardly from front edge 41 and beyond the first side edge 17 of flange 20. The locking ears 40 cooperate with the locking extensions 22 on the flange 20 when the device 10 is in its closed or locked position.

The interconnecting device 10 is mounted to substrate 62 by inserting the legs as shown in FIG. 1 into mounting openings 64 in substrate 62. The device 10 is mounted to the substrate 62 so that the cantilevered spring members 26 will lie juxtaposed to the conductive circuitry 56 on surface 60 of substrate 62. The device 10 is dimensioned so that the legs 39 will be attached to the substrate 62 outside of the area of the circuitry 56. It is to be understood that substrate 62 may be a portion of a circuit board or may simply be a support for connecting cables to each other.

Figure 7:
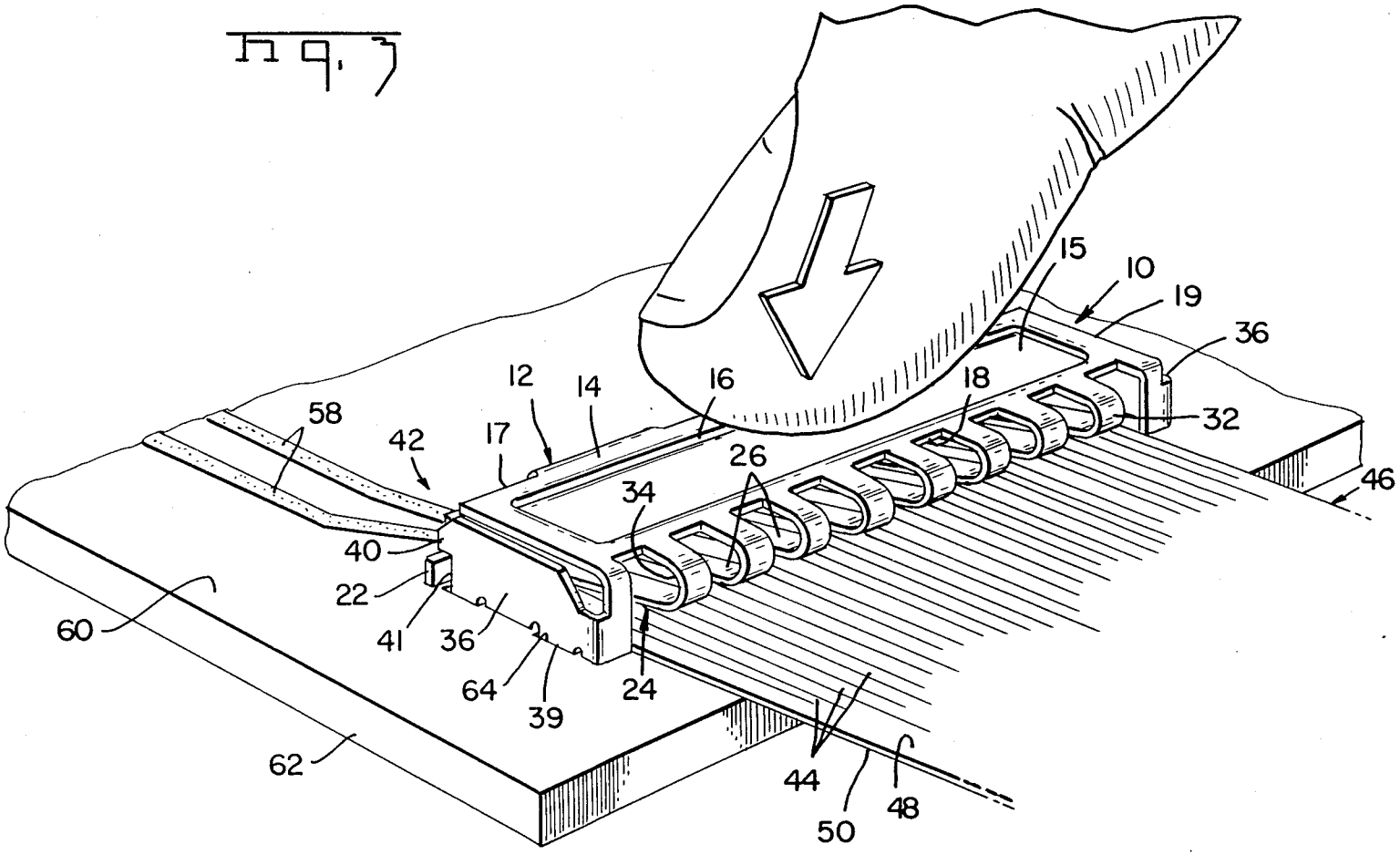
FIG. 7 is a view similar to FIG. 5 taken along line 7—7 of FIG. 6.

The cable 46 is generally of the type having a plurality of flat conductors 44 which are encased within or deposited on a film 48 of insulating material such as a polyester or polyimide film. The conductors may be formed from discrete metal wires, a metal sheet which has been etched to form traces or traces deposited by screening as known in the art. The conductors 44 need to be exposed on the portion of the undersurface of the cable 46 that will be inserted into the device 10. A cable 46 having conductors 44 encased within two layers 48, 50 of dielectric film is used for purposes of illustration as is best shown in FIGS. 5 and 7. A portion of the under layer 50 has been removed to expose the conductors 44.

FIGS. 2, 4 and 5 illustrate the device 10 in its open position. When the device is open the ends 30 of the spring arms 26 lie above the conductors 58 on the substrate and sufficiently spaced apart from them to permit the insertion of the cable 46 between the spring arms 26 and the substrate 62 thus providing for a zero insertion force. In FIGS. 4 and 5 the cable 46 has been inserted between the spring arm members 26 and the substrate 62 so that the exposed cable conductors 44 lie above corresponding conductors 58 on the surface 60. As is best illustrated in FIG. 5, cable 46 is comprised of a layer of insulation 48, a plurality of conductors 44, and a second layer of insulation 50. A portion of the second layer of insulation 50 has been removed from the under surface of the cable 46 where electrical connection is to be effected. The arcuate portion 30 of the spring arm 26 lies against insulation layer 48 and is not a part of the electrical circuit.

FIGS. 3, 6 and 7 illustrate the device 10 in its closed position. As pressure is applied to the first section 14, the first section is deflected, the flange 20 is moved downward and locking means comprised of locking extension 22 and locking ears 40 engage with each other to hold the plate member 15 of the device 10 in the locked position. As the device 10 is locked, pressure is asserted by the spring arms 26 against the insulation 48 and conductors 44 and 58 thus bringing the cable conductors 44 into electrical contact with the corresponding substrate conductor 58. In its second or closed position, the relative inclination between first and second sections 14, 24 is less than the relative inclination between the first and second sections 14, 24 in its opened or first position as is best shown in FIGS. 4 and 6. Energy is stored in the body 12 in the second or closed position. This stored energy is transmitted through the second section 24 to the circuitry array 56 to maintain a normal force and electrical contact between the cable conductors 44 and the circuitry array 56 on the substrate 62.

As shown in FIGS. 8 and 9 the end 28 of the cantilevered spring arm section 26 may be shaped to apply pressure to one or more conductors 44 at the same time. Since pressure is applied through the insulation layer, no electrical interconnection occurs between the adjacent conductors. Depending upon the spacing of the cable conductors 44 and the substrate conductors 58 the end section 30 of the cantilevered arms may be expanded to cover a broader area than the basic width of one conductor. It is preferable, however, that there be a plurality of spring arm members 26 to allow for variations in height of conductors in the substrate circuitry 56 or in a cable 46.

The embodiment of the invention shown in FIGS. 1–3 is particularly advantageous when used with circuit boards having conductors 58 of non-uniform thickness on the upper surfaces 60 of the circuit boards. The conductors are quite often produced by applying solder to metalized portions or bands on the surface of the circuit board, the solder being applied by wave soldering apparatus or other means. In any event, since the solder is applied while it is molten, it sometimes happens that the conductors will not be of uniform thickness. The cantilever springs 26, however, are independent of each other at their ends and the performance of the connector will not therefore be affected by non-uniform thicknesses in the conductors. In other words, if one of the conductors is significantly thicker than the remaining conductors, this "high" connector will not hold the remaining contact springs elevated from the relatively low conductors a single cantilevered spring member may be used where the thickness of the conductors is essentially the same. The dimensions of the device 10 should be related to the dimensions of the cable 46 and the dimensions of the circuitry 56 on the substrate 62. It is not necessary, however, that each individual cantilevered spring arm 26 be dimensioned precisely to the size of the conductor, thus allowing the device to be used on circuitry having a high density of conductors. Since there is no electricity conducted through the interconnection device 10, the individual spring arms may be wider than an individual conductor and in fact span more than one of them.

Interconnection devices in accordance with the invention can be manufactured in strip form with the individual devices 10 connected to a carrier strip. The sections can be stamped and formed and removed from the carrier strip by means known in the art. Preferably the device 10 is stamped and formed of a suitable material having good spring characteristics such as a spring steel. It need not have good electrical conductivity for the reason that it serves to press the cable conductors 44 against conductors 58 of circuitry 56 and does not carry current. Since the device is not electrically involved in the electrical connections, it is not necessary to insulate the device. A thin insulating coating can be used, however, if desired.

It is to be understood that the cable can be of the type having metal conductors, such as flat flexible cable, conductors which have been left on a surface as a result of an etching such as flexible etched cable, and cable in which the conductors have been screened. The zero insertion force characteristics of the device enable all types of cables to be used.

Zero insertion force connector devices in accordance with the invention can be used as a matter of convenience when the film is relatively heavy and the conductors are wrought conductors which will withstand abrasion and compressive force during insertion. The use of the present system will facilitate the insertion operation and permit the technician to concentrate on proper location of the cable in the device 10. The use of the present zero insertion force system is, however, highly desirable if not necessary, when the film is relatively thin and flimsy and the conductors 44 on the cable 46 are extremely fragile and subject to damage. It will thus be apparent that a zero insertion force connector device in accordance with the invention can be used under all circumstances where conductors on a film are to be connected to spaced apart conductors on a substrate.

What is claimed is:

1. An electrical interconnection device for interconnecting conductors in an array to circuitry on the surface of a substrate, the device comprising a unitary spring metal member, the spring metal member further comprising:

first means for securing the spring metal member to the substrate;

a formed metal body having a first section and a second section joined by an intermediate bight, the first and second sections being relatively inclined about an acute included angle in a first position, the first and second sections being mutually relatively deflectable about the bight to a second position in which the relative inclination therebetween is less than in the first position, and a lock depending from the first section for retaining the first and second sections in the second position, energy being stored in the body in the second position, whereby upon positioning the array of conductors between the second body section and the circuitry on the substrate and deflecting the first section to the second position to engage the lock, the stored energy is transmitted through the second section to the conductor array to maintain a normal force electrical contact between the conductors in the array and the circuitry on the substrate.

2. The electrical interconnection device of claim 1 wherein the second body section comprises a plurality of spaced cantilever arms extending from the bight.

3. The electrical interconnection device of claim 1 wherein the first means comprises at least one end section extending from the bight and oriented in a plane mutually perpendicular to the first and second sections in both the first and second position.

4. The electrical interconnection device of claim 3 wherein each end section further comprises a depending leg engagable with the substrate.

5. The electrical interconnection device of claim 3 wherein the end section further comprising a surface engagable with the lock when the first and second sections are in the second position.

6. The electrical interconnection device of claim 1 wherein the first and second section are both deflectable relative to the substrate upon movement from the first to the second position.

7. The electrical interconnection device of claim 6 wherein the second section exerts greater normal force relative to the substrate in the second position than in the first position.

8. The electrical interconnection device of claim 7 wherein the second section exerts zero normal force relative to the substrate in the first position.

9. The electrical interconnection device of claim 1 wherein the lock comprises a flange formed from a free edge of the first section.

10. The electrical interconnection device of claim 9 wherein the flange extends laterally beyond the first section.

11. The electrical interconnection device of claim 10 wherein the second section comprises a plurality of laterally spaced cantilever arms, the flange extending laterally relative to the cantilever arms.

12. The electrical interconnection device of claim 2 wherein the first means comprises at least one end section extending from the bight and oriented in a plane mutually perpendicular to the first and second sections in both the first and second position.

13. The electrical interconnection device of claim 12 wherein the end section further comprising a surface engagable with the lock when the first and second sections are in the second position.

14. The electrical interconnection device of claim 13 wherein the lock comprises at least one flange formed from a free edge of the first section and extending laterally relative to the cantilever arms.

15. The electrical interconnection device of claim 14 wherein the lock comprises at least one flange formed from a free edge of the first section and extending laterally relative to the cantilever arms.

16. A zero insertion force electrical interconnection device for interconnecting conductors in a flat cable to circuit pads on the surface of a rigid substrate, the connector comprising a one-piece integral spring metal member, the spring metal member further comprising;

a formed body having an upper plate and a plurality of lower spaced apart cantilever arms joined to the upper plate by a bight, the upper plate and the cantilever arms being mutually deflectable about the bight between first and second positions, energy being stored in the body in the second position;

an end section extending from the bight and comprising means for securing the spring metal member to the substrate with the included angle between the upper plate and the substrate being greater in the first position than in the second position, and a locking flange depending from the upper plate and engaging the end section in the second position to retain the stored energy in the body, whereby the flat cable, with conductors exposed on one surface thereof can be positioned between the cantilever arms and the substrate conductors pads, with the exposed conductors juxtaposed to the conductor pads and a normal force electrical contact can be established between the cable conductors and the conductor pads by deflecting the upper plate, relative to both the cantilever arms and the substrate, from the first to the second position.

* * * * *